United States Patent [19]

Bruno

[11] Patent Number: 4,821,672

[45] Date of Patent: Apr. 18, 1989

[54] DOCTOR BLADE ASSEMBLY WITH ROTARY END SEALS AND INTERCHANGEABLE HEADS

[76] Inventor: Nick Bruno, 574 Marina Blvd., San Leandro, Calif. 94577

[21] Appl. No.: 64,676

[22] Filed: Jun. 22, 1987

[51] Int. Cl.[4] ..... B05C 1/08

[52] U.S. Cl. ..... 118/261; 101/169; 101/366; 118/259; 118/413

[58] Field of Search ..... 118/261, 259, 413; 101/366, 169

[56] References Cited

U.S. PATENT DOCUMENTS

| | | | |
|---|---|---|---|
| 3,273,536 | 9/1966 | Galer | 118/413 X |
| 3,747,561 | 7/1973 | Helm | 118/259 |
| 4,351,264 | 9/1982 | Flaum et al. | 118/261 X |
| 4,461,211 | 7/1984 | Wesselmann et al. | 101/169 X |
| 4,497,250 | 2/1985 | Dressler | 101/350 |
| 4,559,871 | 12/1985 | Kutzner et al. | 101/366 X |
| 4,581,995 | 4/1986 | Stone | 101/366 |
| 4,590,855 | 5/1986 | Schommer et al. | 101/350 X |
| 4,667,595 | 5/1987 | Geretzki | 101/366 X |

*Primary Examiner*—Stanley Silverman

*Attorney, Agent, or Firm*—Harris Zimmerman; Howard Cohen

[57] ABSTRACT

A doctor blade assembly adapted for applying liquid uniformly to a rotating transfer roller includes an applicator head having a channel-like cavity extending longitudinally parallel to the transfer roller axis. A pair of doctor blades extend obliquely from the longitudinal edges of the channel to impinge on the circumferential surface of the transfer roller. The blades each may be secured by longitudinally spaced screws, or by a blade holder secured to a longitudinal piano hinge and spring biased to clamp the respective blade. A pair of rotary end seals are joined to the opposed ends of the channel to form a sealed chamber against the transfer roller. Each end seal includes an end plate resiliently impinging on the end surface of the transfer roller, and a seal member secured to the end plate and disposed to engage the endmost portion of the circumferential roller surface. A plurality of mounting lugs extend outwardly from the applicator head, each lug including a stepped, semi-cylindrical portion. A like plurality of mounting blocks are secured to support arms extending from a pivot shaft that is parallel to the axis of the transfer roller, each mounting block having a slot dimensioned to receive one of the mounting lugs in precision fit. Mounting screws extend from the support arms and mounting block to the applicator head. A plurality of applicator heads are provided, all with the same mounting lug spacing, so that applicator heads may be interchanged quickly by rotating the pivot shaft away from the transfer roller, sliding the lugs out of the mounting block slots, inserting the lugs of a replacement head into the mounting block slots, tightening the mounting screws, and rotating the shaft to move the replacement head into impingement with the transfer roller.

15 Claims, 4 Drawing Sheets

DOCTOR BLADE ASSEMBLY WITH ROTARY END SEALS AND INTERCHANGEABLE HEADS

BACKGROUND OF THE INVENTION

In the application of liquid substances to a moving web of material, it is considered well known in the art to apply the liquid using a rotating transfer roller, and to directly apply the liquid uniformly onto the roller by means of a doctor blade assembly. The doctor blade assembly generally includes a reservoir chamber extending the length of the transfer roller and in contact with the circumferential surface thereof, and a pair of doctor blades extending longitudinally on either side of the chamber. The doctor blades are angled obliquely toward the transfer roller surface, and serve both to seal the reservoir chamber to the roller and to form a uniform film of liquid on the roller transfer surface. The assembly also must include some means to seal the reservoir chamber at the ends of the roller, so that the liquid is not flung from the roller into the surroundings, and so that the the liquid may be pumped through the reservoir during the transfer process. Such transfer systems are used in flexographic and gravure printing, adhesive applicators in the paper converting industry, coating applicators in many different industrial processes, and the like.

A persistent problem in prior art transfer systems is the sealing arrangement with the transfer roller. It may be appreciated that the transfer roller operates at high speed, on the order of 1000 linear feet per minute, and the end seals of the doctor blade assembly wear quickly. As the end seals wear, the applied liquid is flung from the transfer roller, causing a difficult and messy cleanup problem. Furthermore, the doctor blades themselves must be aligned with the roller with extreme precision, with tolerances to one thousandth of an inch. These two factors combine synergistically to reduce the productivity of the transfer system. That is, when the end seals or the doctor blades are too worn to be used further, the system must be shut down, the head must be removed, and the end seals replaced. Likewise, changing ink color in a printing press also requires removal and replacement of the doctor blade head. When the head is resecured to the transfer roller assembly, it must be carefully aligned to the transfer roller so that the liquid is once again uniformly applied to the roller and to the moving web of material. The steps of rebuilding or replacing the end seals and re-aligning the doctor blade head result in an unacceptable amount of down time for the transfer system. Clearly the prior art indicates the need for a system which reduces the time required to rebuild the end seals and re-align the head.

One approach known in the prior art provides a pair of stationary end seal members impinging on the ends of the transfer roller, so that the doctor blade head may form a seal with the stationary seals rather than with the moving surface of the transfer roller. This sealing arrangement requires sealing hardware to be mounted on the transfer roller and machine frames which is more cumbersome and costly. This system also does not incorporate a feature to easily remove and replace the doctor blade head.

SUMMARY OF THE PRESENT INVENTION

The present invention generally comprises a doctor blade system for transfer roller applicators that overcomes the serious drawbacks in the prior art noted above. One salient feature of the invention is the provision of a doctor blade mounting system that permits the quick change of interchangeable doctor blade heads, so that as the doctor blades wear out, the doctor blade head may be replaced within seconds by a fresh doctor blade head. Likewise, changing of ink color on a printing press may be accomplished with very little down time by using interchangeable doctor blade heads.

Furthermore, the mounting system of the invention is designed to align the interchangeable doctor blade heads with a precision and repeatability unknown in the prior art, so that setup time and downtime are virtually eliminated.

The doctor blade assembly adapted for applying liquid uniformly to a rotating transfer roller includes an applicator head having a channel-like cavity extending longitudinally parallel to the transfer roller axis. A pair of doctor blades extend obliquely from the longitudinal edges of the channel to impinge on the circumferential surface of the transfer roller. The blades each may be secured either by longitudinally spaced screws, or, in an alternative embodiment, by a blade holder secured to a longitudinal piano hinge and spring biased to clamp the respective blade.

The invention includes pair of rotary end seals joined to the opposed ends of the channel to form a sealed engagement against the moving surface of the transfer roller. Each end seal includes an end plate resiliently impinging on the end surface of the transfer roller, and a seal member secured between the end plate and the end of the channel member and disposed to engage the endmost portion of the circumferential roller surface. The seal members are easily replaced by quick removal of the end plates an substitution of new seal members.

The quick change mounting feature includes a plurality of mounting lugs extending outwardly from the outer longitudinal surface of the applicator head, each lug including a stepped, semi-cylindrical portion. A like plurality of mounting blocks are secured to a pivot shaft extending parallel to the axis of the transfer roller, each mounting block having a slot dimensioned to receive one of the mounting lugs in precision fit, in the manner of a Woodruff key arrangement. At least two applicator heads are provided, with the same precision mounting lug spacing, so that applicator heads may be interchanged quickly by rotating the pivot shaft away from the transfer roller, sliding the lugs out of the mounting block slots, inserting the lugs of a replacement head into the mounting block slots, and rotating the shaft to move the replacement head into impingement with the transfer roller. The mounting blocks are provided with vernier adjustment mechanisms to facilitate alignment of the heads with the transfer roller; however, after the system is set up, heads may be interchanged with little or no readjustment.

DESCRIPTION OF THE PREFERRED EMBODIMENT

Figure 1:
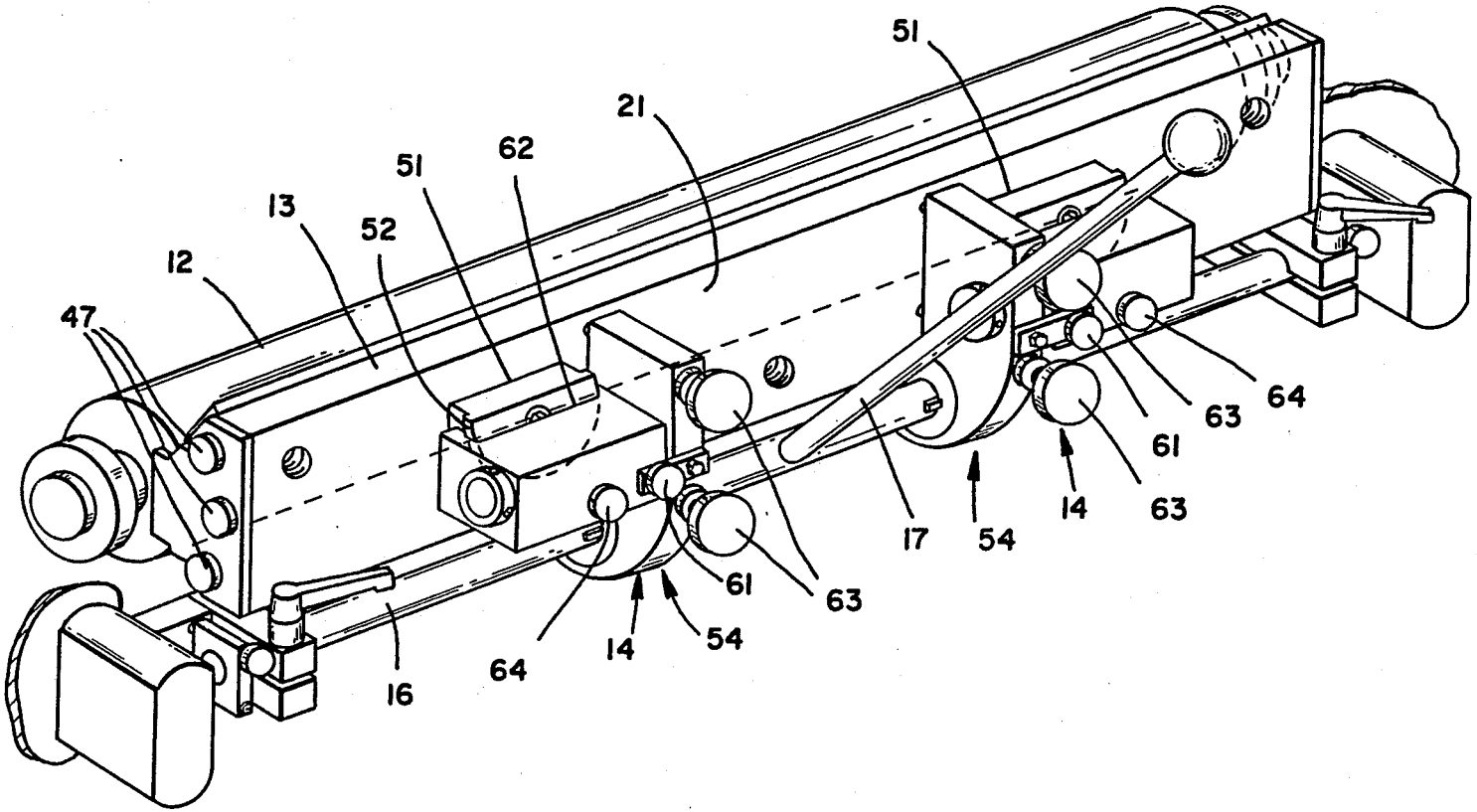
FIG. 1 is a perspective view of the doctor blade system of the present invention, shown engaged with a typical prior art transfer roller.

The present invention generally comprises an improved doctor blade assembly for use in applying liquids in general to a transfer roller, such as in printing presses, adhesive applicators, coating machines, and the like. With regard to FIG. 1, a typical transfer roller 12 is shown, the roller being adapted to apply liquid either to a printing drum or to apply liquid directly to a moving web of material, as is known in the prior art. The liquid is supplied to the roller 12 by a doctor blade applicator head 13 which is secured by a mounting arrangement 14 to a pivot shaft 16 extending parallel to the axis of rotation of the transfer roller. A handle 17 extends from the pivot shaft 16 to facilitate rotation of the shaft 16 and movement of the head 13 into and out of engagement with the transfer roller.

Figure 3:
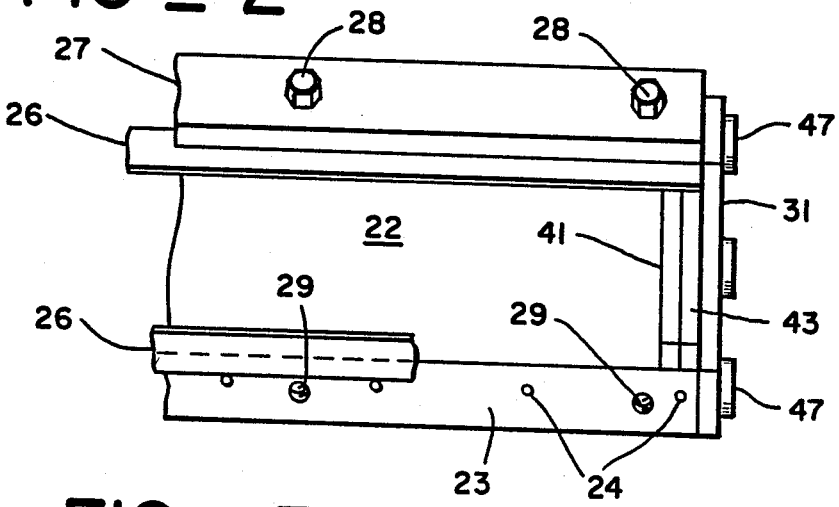
FIG. 3 is a partial plan view of the doctor blade head, showing the liquid chamber and the doctor blades.
Figure 8:
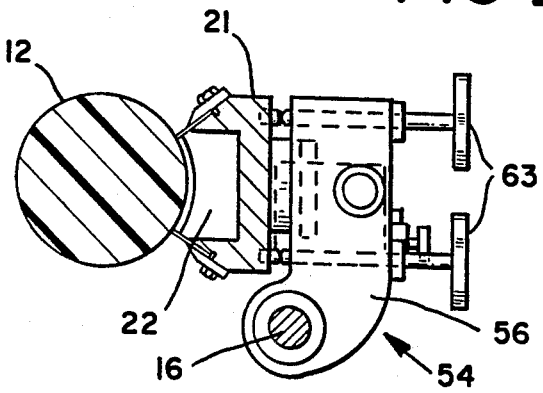
FIG. 8 is a cross-sectional elevation of the doctor blade system, taken along line 8—8 of FIG. 7.
Figure 9:
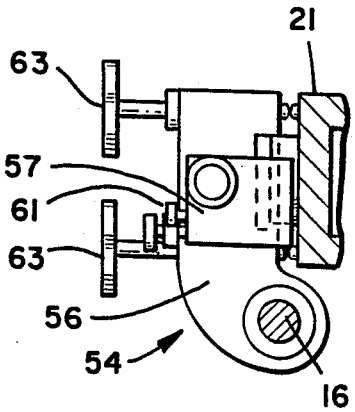
FIG. 9 is a partial cross-sectional elevation of the doctor blade system, taken along line 9—9 of FIG. 7.

The primary structural component of the head 13 is a channel-like member 21, shown particularly in FIGS. 3 and 8. The member 21 includes an open-ended channel cavity 22 extending longitudinally therein, and the longitudinally extending sides 23 of the member 21 are sloped obliquely in outwardly converging fashion. A plurality of locating pins 24 are spaced along the surfaces 23 to provide alignment for a pair of doctor blades 26, as shown in FIG. 3. A pair of blade covers 27 are also provided, each disposed atop one of the blades 26 and secured by screws 28 extending into tapped holes 29 extending into the respective surfaces 23. The blades 26 are aligned precisely by the pins 24 to be parallel to each other and to the axis of the cavity 22. The confronting edges of the blades extend beyond their respective blade covers to impinge on the circumferential surface of the transfer roller, as shown in FIG. 8.

Figure 5:
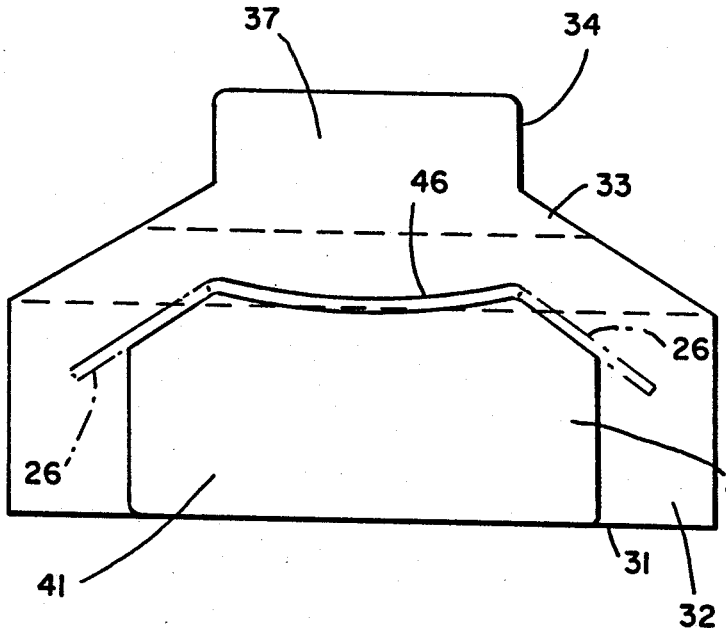
FIG. 5 is an enlarged inside end view of the seal assembly of the present invention.
Figure 6:
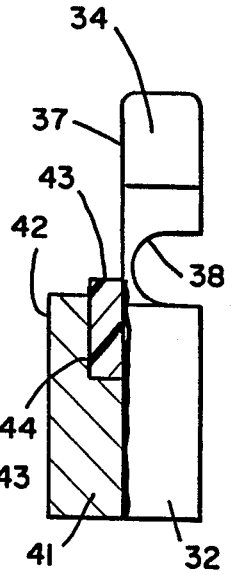
FIG. 6 is a partially sectioned side view of the end seal assembly as shown in FIG. 5.

The doctor blade applicator head 13 also includes a pair of end seal assemblies adapted to seal the open ends of the channel cavity 22 and to engage the rotating transfer roller in sealing fashion. As shown in FIGS. 5 and 6 in particular, each end seal assembly includes an end plate 31 formed of a resilient, durable polymer such as Delrin TM or the like. Each end plate 31 includes a generally retangular base portion 32, a medial portion 33 having tapering, converging sides, and an upper tab-like portion 34. The medial and upper portions 33 and 34 include a continuous surface 37 which is adapted to impinge directly on the end surface of the transfer roller, as shown for example in FIG. 7. To enhance the resilient impingement on the roller end surface, the medial portion of the end plate is provided with a deep groove 38 extending laterally in the end plate surface opposite the surface 37. The groove 38 permits increased flexure of the portion impinging on the transfer roller, and aids in forming a seal between the surface 37 and the end of the transfer roller. The spacing of the confronting surfaces 37 of the two end plates is slightly less than the length of the transfer roller, so that the end plates impinge on the ends of the roller sufficiently tightly to prevent any significant slinging of liquid from the ends of the transfer roller.

The end seal also includes an inner end plate 41 secured to the respective end surface of the channel member. It may be appreciated that the base portion 32 of the end plate 31 is sufficiently wide to span the end of the channel member 21, and that the inner plate 41 includes an inset portion dimensionsed to fit within the channel cavity 22 in close fit. The end plate 31 and 41 thus serve to close the open ends of the channel cavity in liquidretaining fashion. In addition, the inner plate 41 includes a tab portion 42 extending upwardly therefrom to define an interior pocket 44 between it and the confronting end plate surface. A soft, resilient seal member 43 is secured within the pocket 44. The tab portion 42 includes an arcuate upper surface, and the upper surface of the seal member 43 is likewise provided with an arcuate upper surface 46 spaced upwardly from the tab portion. The surface 46 is curved to conform to the circumferential surface of the transfer roller 12, and is disposed to impinge on the endmost portion of the circumferential surface in sealing fashion.

It should be noted that the doctor blade head 13 is designed to engage the transfer roller in a sealed fashion. That is, the doctor blades engage the entirety of the generally smooth surface of the transfer roller and permit only a thin film of liquid to discharge from the cavity 22 to the transfer roller. The end seal assembly seals the open ends of the channel cavity, and also forms a seal between the ends of the doctor blade assembly and the ends of the transfer roller. Thus the channel cavity 22 is sealed as a closed chamber with the transfer roller, and this closed chamber retains a reservoir of liquid to be applied to the roller. Indeed, the head 13 also includes means (not shown) for circulating a liquid, such as printing ink or bonding adhesive, through the chamber, so that the liquid remains constant in viscosity and uniform in composition.

Figure 2:
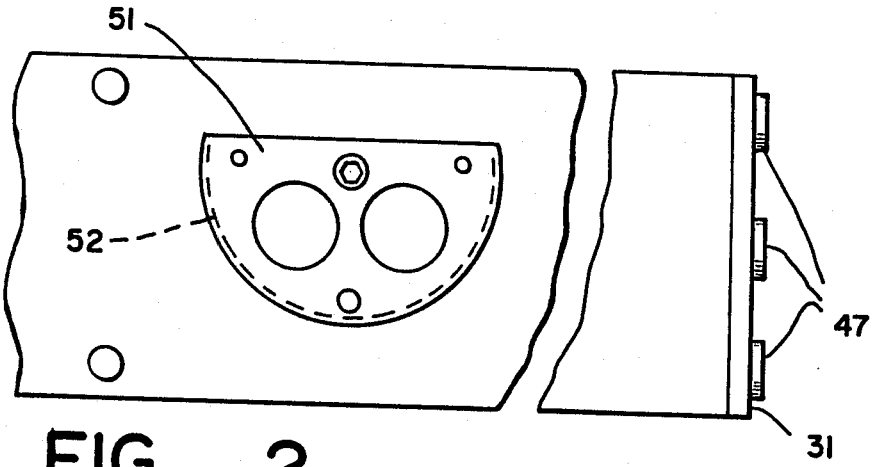
FIG. 2 is a partial elevation of the outer longitudinal surface of the doctor blade head of the present invention, showing in particular a mounting lug thereof.
Figure 4:
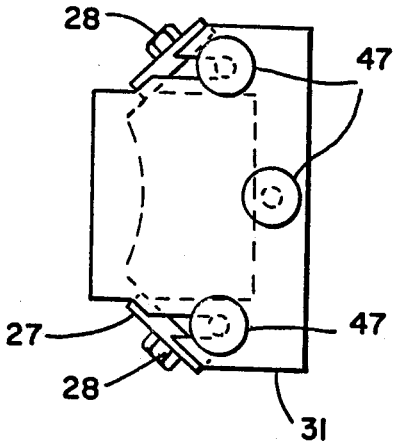
FIG. 4 is an end elevation of the end plate of the seal assembly of the present invention.

The seal member 43, although being formed of soft resilient rubber material or the like, is able to withstand rapid wear against the rapidly rotating roller surface. To facilitate the removal and replacement of the seal member 43, the end plates 31 are secured to the ends of the member 21 by means of a plurality of screws 47 having knob ends for easy manipulation without special tools, as shown in FIGS. 2-4.

Figure 7:
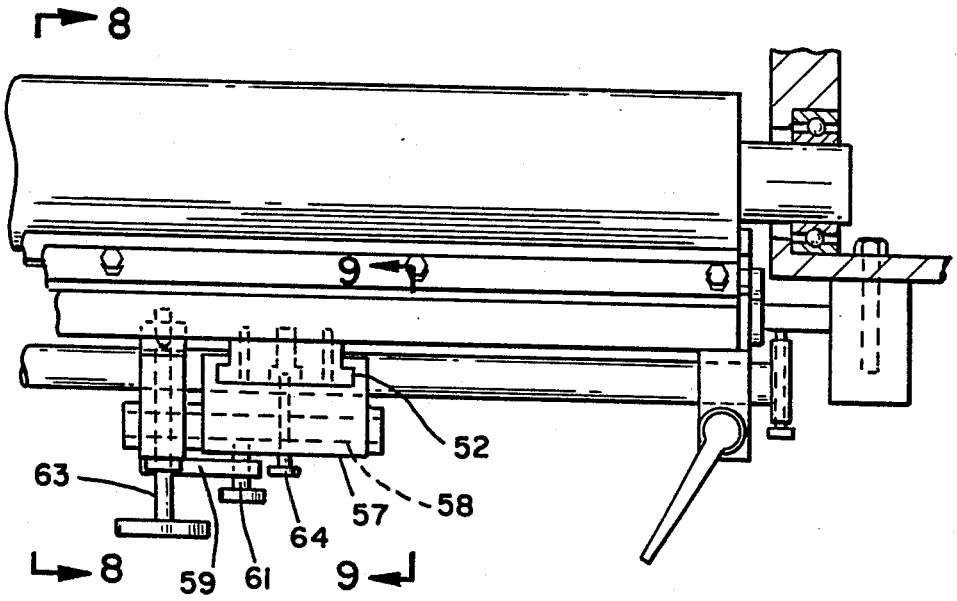
FIG. 7 is a partial top view of the doctor blade system of the present invention, shown engaged with a typical transfer roller.
Figure 10:
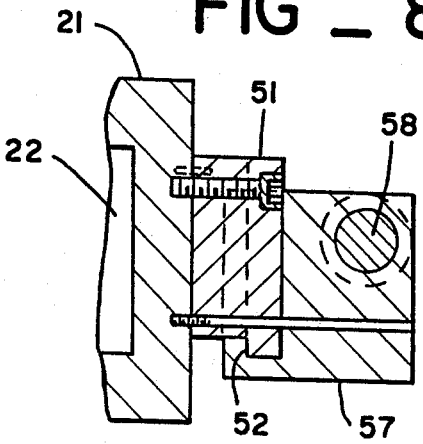
FIG. 10 is a cross-sectional elevation of the mounting block-mounting lug engagement of the doctor blade system of the present invention.

As noted in the foregoing, an important aspect of the present invention is the provision of interchangeable doctor blade heads 13, and a mounting system 14 that permits the quick exchange of heads and realignment of a replacement head with the transfer roller. With regard to FIGS. 1 and 2, each head 13 is provided with a pair of mounting lugs 51 spaced longitudinally, all of the interchangeable heads having the same lugs 51 disposed precisely at the same spacing and location. The lugs 51, which extend from the outer longitudinal surface of the head, are shaped as sections of a cylinder extending orthogonally from the head each section comprising slightly more than 180° of the cylinder. In addition, the outer end of each lug is provided wih a flange 52 extending radially outwardly from the cylinder in stepped fashion, as shown in FIGS. 1, 7, and 10.

The mounting arrangement 14 also includes a pair of support arm assemblies 54, each joined to the pivot shaft 16 and rigidly affixed thereto in precise alignment parallel to each other. The support arm assemblies are formed as identical, mirror image assemblies so that the description of one will suffice for both. With regard to FIGS. 1 and 7–10, each assembly 54 includes a support arm 56 formed in dogleg fashion, the offset end of the arm provided with a hole through which the shaft 16 is received and keyed. A mounting block 57 is joined to the support arm by means of a stub shaft 58, so that the mounting block may be pivoted about an axis that is parallel to the axes of the shaft 16 and the transfer roller 12. A bar 59 extends from the support arm adjacent to the mounting block 57, and an angle setting screw 61 extends from the bar 59 to be received in a tapped hole in the mounting block. It may be appreciated that, due to the offset between the screw and the shaft 58, the knob head of the screw may be turned to selectively limit the range of angles or repose of the mounting block with respect to the support arm when a doctor blade head is not secured to the mounting block.

Each mounting block is provided with an slot 62 extending into the upper surface thereof and having a stepped, semi-cylindrical conformation complementary to one of the mounting lugs 51. Each support arm further includes a pair of mounting screws 63 extending therethrough and aligned to impinge on hardened buttons extending from the outer surface of the head 13. The screws 63 thus set the angle of the head with respect to the support arm. A further set screw 64 extends from the outer surface of the mounting block to the slot 62, and is disposed to be received in a tapped hole provided in the mounting lug 51, as shown in FIG. 7.

It may be appreciated that the handle 17 may be employed to rotate the shaft 16 and swing the doctor blade head 13 away from the transfer roller 12, and that the head may easily be removed from the mounting blocks by releasing the screws 64, and lifting the head to remove the mounting lugs from the mounting slots 62. To replace the removed head, a further head 12 is secured by first placing its mounting lugs 51 into the slots 62 of the mounting blocks, thereby automatically aligning all the relevant screw holes. The screws 64 are then tightened into the mounting lugs, and the screws 63 maintain the requisite setup angle of the replacement head. It should be noted that the screws 63 and 64 include lock nuts which aid in setting the position of the doctor blade head, and which remain fixed once the setup is perfected. The new head is thereby aligned with the mounting blocks precisely in the position of the removed head. The handle 17 then is rotated to swing the new head into engagement with the transfer roller. A stop on the shaft 16 (not shown) limits the head movement toward and away from the transfer roller.

The angle adjustment control screw 61 is employed for setup purposes to hold the mounting blocks in position to receive a doctor blade head. Due to precise machining and placement of the mounting lugs and screws, the angle adjustment set by the screws 63 should not require any modification during replacement of the doctor blade heads. The quick change capability and interchangeability of the heads, together with the accurate repeatability of placement of the heads, virtually eliminates downtime for the transfer roller system. Furthermore, the end seals are adapted to be disassembled and replaced quickly, and this task may be accomplished off-line while the transfer roller system continues to operate.

Figure 11:
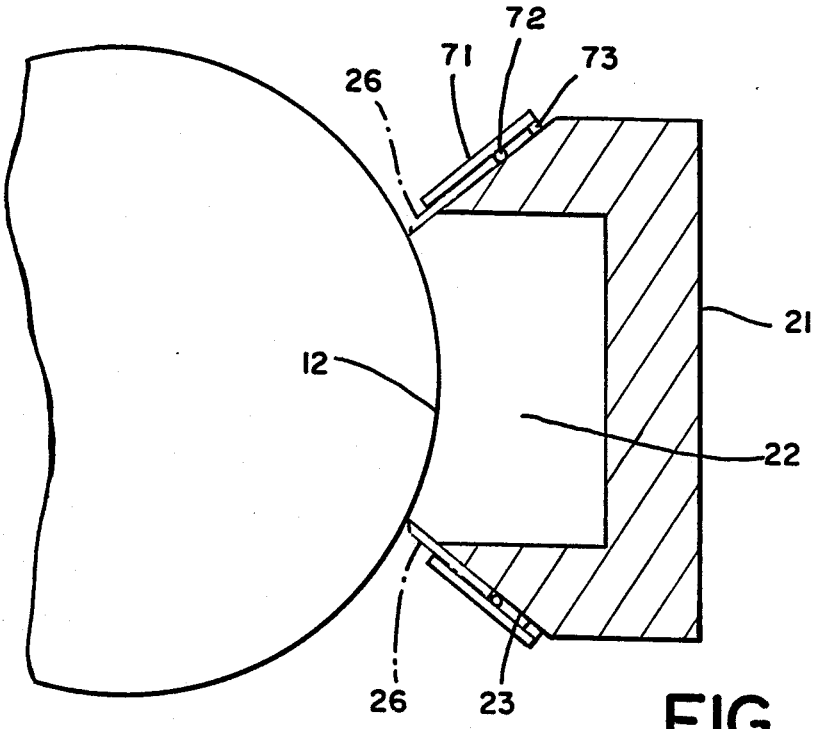
FIG. 11 is a cross-sectional end view of a further embodiment of the invention for mounting the doctor blades on the applicator head.

A further embodiment of the invention, shown in FIG. 11, discloses another system for securing the doctor blades 26 to the surfaces 23 of the member 21. A pair of piano hinges 71 are each secured longitudinally along the entire length of one of the surfaces 23, and a blade cover 72 is secured to each of the piano hinges. A plurality of coil springs 73 are secured in recesses spaced along each surface 23, and disposed to expand against one edge of the respective blade cover 72 and drive the blade cover to clamp the blade 26 against the surface 23. This system permits quicker removal and replacement of the doctor blades, which are also subject to wear and require periodic maintenance.

I claim:

1. A doctor blade assembly adapted for applying a liquid uniformly to a rotating transfer roller, comprising;

a longitudinally extending doctor blade head having a channel-like cavity formed therein and oriented parallel to the transfer roller, a pair of doctor blades disposed on opposed sides of said cavity and extending the length thereof and adapted to impinge on the transfer roller, said pair of doctor blades extending parallel to the transfer roller and converging as they extend from said opposed sides of said cavity toward the transfer roller, a pair of end seal assemblies secured to said doctor blade head and disposed at opposite ends of said cavity, each end seal assembly including means for establishing a high pressure liquid seal with a rotating peripheral surface portion of the transfer roller at a respective end of the transfer roller, and means for supporting said doctor blade head and removably positioning said doctor blade head so that said doctor blades may be moved into and out of engagement with the transfer roller.

2. The doctor blade assembly of claim 1, further including a plurality of said doctor blade heads, said means for supporting said doctor blade head including means for interchangeably removing and securing any one of said plurality of doctor blade heads in substantially identical alignment with respect to the transfer roller.

3. The doctor blade assembly of claim 2, wherein said means for supporting said doctor blade heads include a plurality of mounting lugs extending from each of said doctor blade heads, a like plurality of mounting blocks, a plurality of slots, each extending into one of said mounting blocks and dimensioned to receive one of said mounting lugs in close fit, and support arm means connected to said mounting blocks.

4. The doctor blade assembly of claim 3, wherein said support arm means includes a pivot shaft extending generally parallel to the transfer roller, and a like plurality of support arms extending fixedly from said pivot shaft in parallel alignment each to the other.

5. A doctor blade assembly adapted for applying a liquid uniformly to a rotating transfer roller, comprising;

a longitudinally extending doctor blade head having a channel-like cavity formed therein and oriented parallel to the transfer roller, a pair of doctor blades disposed on opposed sides of said cavity and extending the length thereof and adapted to impinge on the transfer roller, a pair of end seal assemblies secured to said doctor blade head and disposed at opposite ends of said cavity, each end seal assembly including means for establishing a liquid seal with a rotating peripheral surface portion of the transfer roller at a respective end of a transfer roller, means for supporting said doctor blade head and removably positioning said doctor blade head so that said doctor blades may be moved into and out of engagement with the transfer roller, a plurality of said doctor blade heads, said means for supporting said doctor blade head including means for interchangeably removing and securing any one of said plurality of doctor blade heads in substantially identical alignment with respect to the transfer roller, said means for supporting said doctor blade heads including a plurality of mounting lugs extending from each of said doctor blade heads, a like plurality of mounting blocks, a plurality of slots, each extending into one of said mounting blocks and dimensioned to receive one of said mounting lugs in close fit, and support arm means connected to said mounting blocks, said support arm means including a pivot shaft extending generally parallel to the transfer roller, and a like plurality of support arms extending fixedly from said pivot shaft in parallel alignment each to the other, and means for joining each of said mounting blocks to one of said support arms, including a stub shaft extending from each of said support arms and pivotally received in a respective mounting block, said stub shaft extending generally parallel to said pivot shaft and said transfer roller.

6. The doctor blade assembly of claim 5, further including adjustment means for selectively setting the angular disposition of each of said mounting blocks about the respective stub shaft.

7. The doctor blade assembly of claim 5, further including a plurality of mounting screws extending from each of said support arms and adapted to impinge on hardened buttons extending from an outer surface of each of said doctor blade heads.

8. The doctor blade assembly of claim 1, wherein said end seal assemblies each include an end plate removably secured to a longitudinally opposed end of said doctor blade head and having a proximal end portion dimensioned to extend across one end of said channel-like cavity in sealing fashion, said end plate further including a distal end portion disposed to impinge on the end surface of the transfer roller.

9. The doctor blade assembly of claim 8, wherein each of said end seal assemblies further includes a resilident seal member secured to said end plate, said resilient seal member including a distal surface disposed to impinge on a rotating circumferential portion of the transfer roller.

10. The doctor blade assembly of claim 9, wherein said distal surface of said resilient seal member is provided with an arcuate conformation complementary to the curvature of the transfer roller.

11. The doctor blade assembly of claim 9, wherein each of said end seal assemblies further includes an inner plate secured to said end plate and disposed to retain said resilient seal member therebetween.

12. The doctor blade assembly of claim 1, further including means for removably securing said pair of doctor blades to said head, including a pair of longitudinally disposed oblique surfaces extending along opposed sides of said channel-like cavity, a plurality of locating pins spaced along each of said oblique surfaces, and a pair of blade covers, each disposed to be removably secured to one of said oblique surfaces and to clamp a respective one of said doctor blades therebetween.

13. The doctor blade assembly of claim 1, further including means for removably securing said pair of doctor blades to said head, including a pair of longitudinally disposed oblique surfaces extending along opposed sides of said channel-like cavity, a pair of piano hinges, each extending substantially the length of one of said oblique surfaces, a pair of blade cover members, each secured to one of said piano hinges, and resilient means for biasing each of said blade cover members to rotate and impinge on the respective oblique surface and clamp one of said doctor blades therebetween.

14. A doctor blade assembly adapted for applying a liquid uniformly to a rotating transfer roller, comprising;

a longitudinally extending doctor blade head having a channel-like cavity formed therein and oriented parallel to the transfer roller, a pair of doctor blades disposed on opposed sides of said cavity and extending the length thereof and adapted to impinge on the transfer roller, a pair of end seal assemblies secured to said doctor blade head and disposed at opposite ends of said cavity, each end seal assembly including means for establishing a liquid seal with a rotating peripheral surface portion of the transfer roller at a respective end of the transfer roller, means for supporting said doctor blade head and removably positioning said doctor blade head so that said doctor blades may be moved into and out of engagement with the transfer roller, said end seal assemblies each including an end plate removably secured to a longitudinally opposed end of said doctor blade head and having a proximal end portion dimensioned to extend across one end of said channel-like cavity in sealing fashion, said end plate further including a distal end portion disposed to impinge on the end surface of the transfer roller, each of said distal portions of said end plates including a planar surface portion adapted to impinge on the end of said transfer roll, and further including a second surface opposed to said planar surface portion, and groove means extending in said second surface to provide enhanced resilient engagement of said distal end portion against the end surface of said transfer roller.

15. A doctor blade assembly adapted for applying a liquid uniformly to a rotating transfer roller, comprising;

a longitudinally extending doctor blade head having a channel-like cavity formed therein and oriented parallel to the transfer roller, a pair of doctor blades disposed on opposed sides of said cavity and extending the length thereof and adapted to impinge on the transfer roller, said pair of doctor blades extending parallel to the transfer roller and converging as they extend from said opposed sides of said cavity toward the transfer roller, a pair of end seal assemblies secured to said doctor blade head and disposed at opposite ends of said cavity, each end seal assembly including means for establishing a high pressure liquid seal with a rotating peripheral surface portion of the transfer roller at a respective end of the transfer roller and means for overlapping the respective end surface of the transfer roller, and means for supporting said doctor blade head and removably positioning said doctor blade head so that said doctor blades may be moved into and out of engagement with the transfer roller.

* * * * *